US011809140B2

(12) United States Patent
Takasawa

(10) Patent No.: US 11,809,140 B2
(45) Date of Patent: Nov. 7, 2023

(54) HOUSING AND DEVICE

(71) Applicant: Seiko Epson Corporation, Tokyo (JP)

(72) Inventor: Koki Takasawa, Suwa (JP)

(73) Assignee: SEIKO EPSON CORPORATION

( * ) Notice: Subject to any disclaimer, the term of this patent is extended or adjusted under 35 U.S.C. 154(b) by 362 days.

(21) Appl. No.: 17/118,808

(22) Filed: Dec. 11, 2020

(65) Prior Publication Data

US 2021/0181685 A1 Jun. 17, 2021

(30) Foreign Application Priority Data

Dec. 13, 2019 (JP) ..... 2019-225201

(51) Int. Cl.

| | |
|---|---|
| ***C23C 8/00*** | (2006.01) |
| ***G04B 37/22*** | (2006.01) |
| ***C23C 28/00*** | (2006.01) |
| ***C23C 8/26*** | (2006.01) |
| ***C21D 6/00*** | (2006.01) |
| ***C21D 9/00*** | (2006.01) |

(52) U.S. Cl.

CPC ..... *G04B 37/22* (2013.01); *C21D 6/002* (2013.01); *C21D 9/0068* (2013.01); *C23C 8/00* (2013.01); *C23C 8/26* (2013.01); *C23C 28/34* (2013.01); *C23C 28/36* (2013.01); *C21D 2211/001* (2013.01); *C21D 2211/005* (2013.01)

(58) Field of Classification Search

CPC ..... C21D 6/002

See application file for complete search history.

(56) References Cited

U.S. PATENT DOCUMENTS

| | | | |
|---|---|---|---|
| 7,875,128 | B2 | 1/2011 | Kuroda et al. |
| 2006/0130938 | A1 | 6/2006 | Kramer |
| 2007/0217293 | A1 | 9/2007 | Takasawa |
| 2009/0073815 | A1 | 3/2009 | Takasawa |
| 2014/0219856 | A1 | 8/2014 | Oliver et al. |
| 2017/0088912 | A1 | 3/2017 | Fukuda et al. |

FOREIGN PATENT DOCUMENTS

| | | | |
|---|---|---|---|
| JP | 2000-155182 | A | 6/2000 |
| JP | 2005-097682 | A | 4/2005 |
| JP | 2007-056301 | A | 3/2007 |
| JP | 2007-239060 | A | 9/2007 |
| JP | 2007-248397 | A | 9/2007 |
| JP | 2009-069049 | A | 4/2009 |
| JP | 2013-101157 | A | 5/2013 |
| JP | 2014-526613 | A | 10/2014 |
| JP | 2018-131643 | A | 8/2018 |
| WO | 2021-100687 | A1 | 5/2021 |

*Primary Examiner* — Jophy S. Koshy

(74) *Attorney, Agent, or Firm* — Harness, Dickey & Pierce, P.L.C.

(57) ABSTRACT

A housing is a housing formed of austenitized ferritic stainless steel including a base formed of a ferrite phase and a surfacing layer formed of an austenitized phase in which the ferrite phase is austenitized, the housing including a first surface exposed to an external space of the housing, and a second surface adjacent to the first surface with a corner portion interposed therebetween, and exposed to the external space, wherein an angle of an internal angle formed by the first surface and the second surface at the corner portion is greater than 0°, and less than 180°, and a surfacing layer at the corner portion is thicker in thickness than a surfacing layer in the first surface and a surfacing layer in the second surface.

6 Claims, 2 Drawing Sheets

HOUSING AND DEVICE

The present application is based on, and claims priority from JP Application Serial Number 2019-225201, filed Dec. 13, 2019, the disclosure of which is hereby incorporated by reference herein in its entirety.

BACKGROUND

1. Technical Field

The present disclosure relates to a housing and a device.

2. Related Art

JP 2013-101157 A discloses a watch housing using ferritic stainless steel in which a surfacing layer is austenitized by nitrogen absorption treatment, specifically, a case band and a case back.

In JP 2013-101157 A, austenitization of the surfacing layer of ferritic stainless steel results in hardness, corrosion resistance, and antimagnetic performance required as a watch housing.

When the housing of JP 2013-101157 A, for example, is dropped, an outer surface is impacted. In this case, particularly, a corner portion is easily subjected to strong impact, and a frequency of strong impact is high, thus such a corner portion needs to be reinforced, but JP 2013-101157 A does not describe any such reinforcing of a corner portion. Thus, there is a demand for a housing that is robust against impact by dropping or the like.

SUMMARY

A housing of the present disclosure is a housing formed of austenitized ferritic stainless steel including a base formed of a ferrite phase and a surfacing layer formed of an austenitized phase in which the ferrite phase is austenitized, the housing including a first surface exposed to an external space of the housing, and a second surface that is adjacent to the first surface with a corner portion interposed therebetween, and that is exposed to the external space, wherein a surfacing layer at the corner portion is thicker in thickness than a surfacing layer in the first surface and a surfacing layer in the second surface.

A device including the housing of the present disclosure.

DESCRIPTION OF EXEMPLARY EMBODIMENTS

Exemplary Embodiment

A watch 1 of an exemplary embodiment of the present disclosure will be described below with reference to the drawings.

Figure 1:
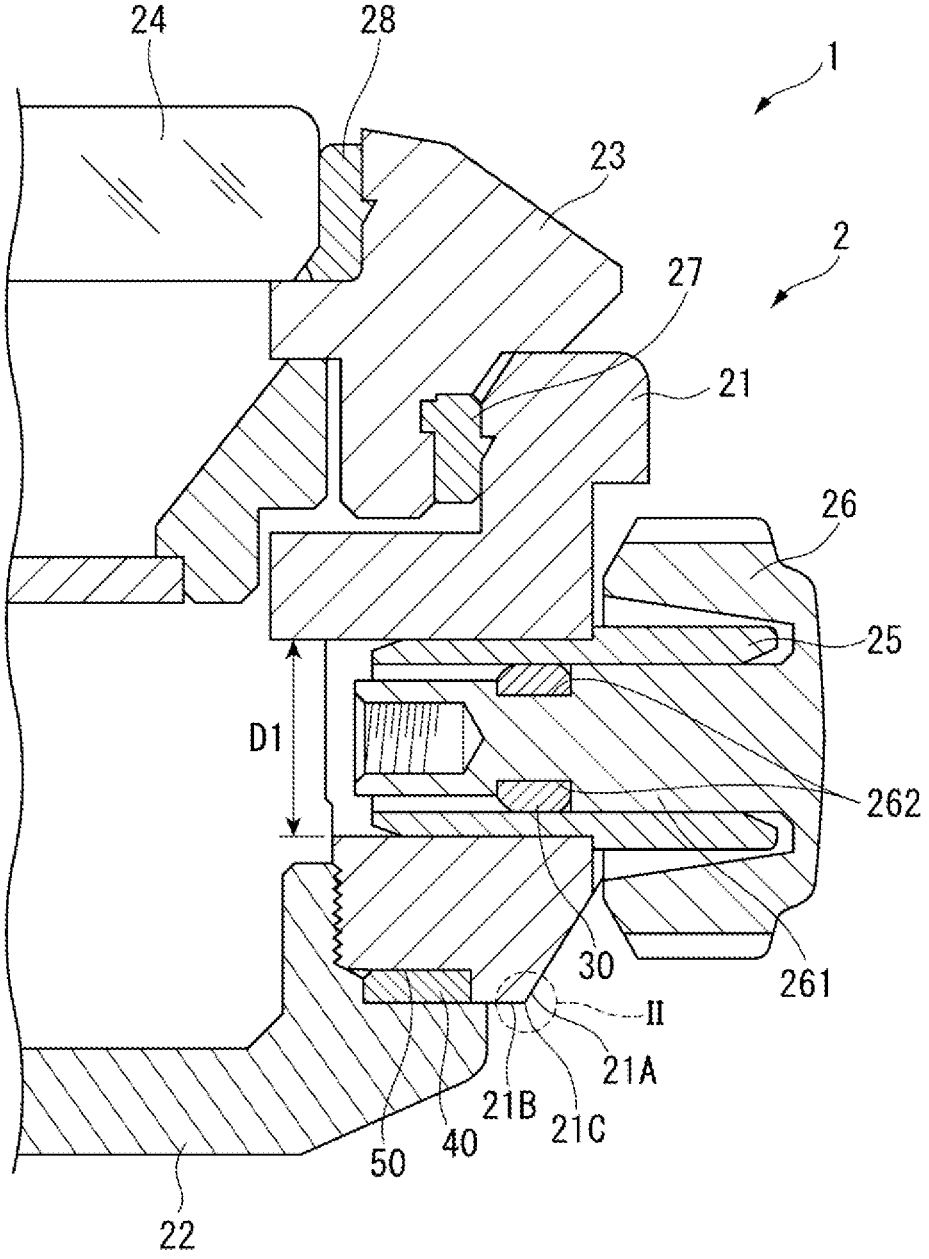
FIG. 1 is a partial cross-sectional view schematically illustrating a watch of an exemplary embodiment.

FIG. 1 is a partial cross-sectional view schematically illustrating the watch 1 of the present exemplary embodiment.

As illustrated in FIG. 1, the watch 1 includes an outer packaging case 2. The outer packaging case 2 includes a cylindrical case main body 21, a case back 22 fixed to a back surface side of the case main body 21, an annular bezel 23 fixed to a front surface side of the case main body 21, and a glass plate 24 held by the bezel 23. Furthermore, a movement (not illustrated) is housed in the case main body 21. Note that, the case main body 21 is an example of a housing of the present disclosure, and the watch 1 is an example of a device of the present disclosure.

A winding stem pipe 25 fits into and is fixed to the case main body 21, and a shaft portion 261 of a crown 26 is rotatably inserted into the winding stem pipe 25.

The case main body 21 and the bezel 23 engage with each other via a plastic packing 27, and the bezel 23 and the glass plate 24 are fixed to each other by a plastic packing 28.

Furthermore, the case back 22 is engaged with the case main body 21, and a ring-shaped rubber packing or case back packing 40 is interposed in a seal portion 50 in a compressed state. With this configuration, the seal portion 50 is liquid-tightly sealed, and a waterproof function is obtained.

A groove 262 is formed at an outer periphery halfway the shaft portion 261 of the crown 26, and a ring-shaped rubber packing 30 is fitted into the groove 262. The rubber packing 30 adheres to an inner circumferential surface of the winding stem pipe 25, and is compressed between the inner circumferential surface and an inner surface of the groove 262. According to this configuration, a gap between the crown 26 and the winding stem pipe 25 is liquid-tightly sealed and a waterproof function is obtained. Note that, when the crown 26 is rotated and operated, the rubber packing 30 rotates together with the shaft portion 261 and, slides in a circumferential direction while adhering to the inner circumferential surface of the winding stem pipe 25.

Case Main Body

Figure 2:
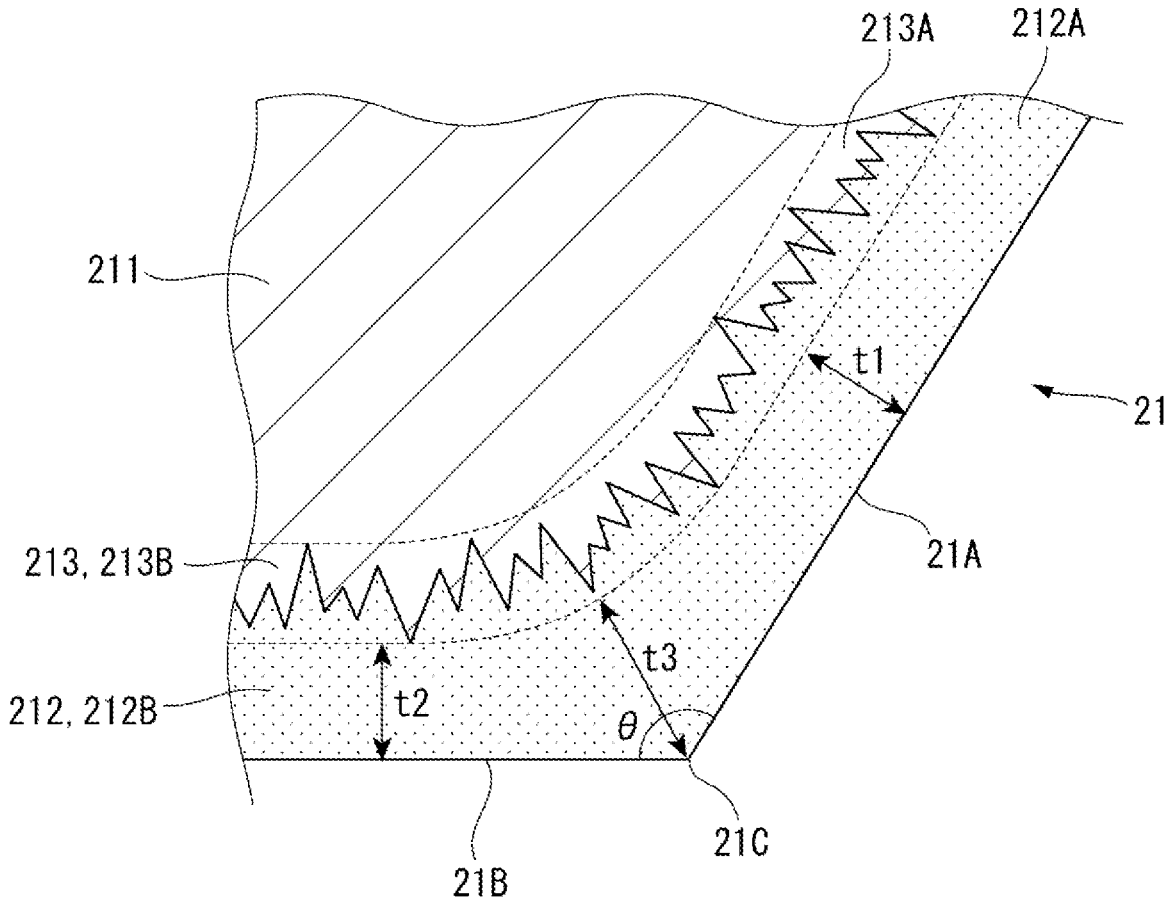
FIG. 2 is an enlarged cross-sectional view illustrating a main part of a case main body.

FIG. 2 is an enlarged cross-sectional view of a main part of the case main body 21, specifically, a region II in FIG. 1.

As illustrated in FIG. 2, the case main body 21 is formed of ferritic stainless steel including a base 211 formed of a ferrite phase, a surfacing layer 212 formed of an austenite phase (hereinafter, an austenitized phase) in which the ferrite phase is austenitized, and a mixed layer 213 in which the ferrite phase and the austenitized phase are mixed with each other.

Further, in the present exemplary embodiment, the case main body 21 includes a first surface 21A exposed to an external space of the case main body 21, and a second surface 21B that is adjacent to the first surface 21A with a corner portion 21C interposed therebetween, and is exposed to the external space. In other words, the corner portion 21C is a location that couples the first surface 21A with the second surface 21B.

Then, the corner portion 21C is configured such that an angle θ of an internal angle formed by the first surface 21A and the second surface 21B is greater than 0° and less than 180°. In other words, the first surface 21A and the second surface 21B are configured such that the corner portion 21C protrudes toward the external space.

Note that, in the present exemplary embodiment, the first surface 21A and the second surface 21B are surfaces that are disposed closer to the case back 22 than the crown 26. Also, the second surface 21B is partially in contact with the case back 22.

Base

The base 211 contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of ferritic stainless steel formed of Fe and unavoidable impurities.

Cr is an element that increases a transfer rate of nitrogen to the ferrite phase, and a diffusion rate of nitrogen in the ferrite phase, in nitrogen absorption treatment. When Cr is less than 18%, the transfer rate and diffusion rate of nitrogen decrease. Furthermore, when Cr is less than 18%, corrosion resistance of the surfacing layer 212 deteriorates. On the other hand, when Cr exceeds 22%, hardening occurs, and workability as a material worsens. Furthermore, when Cr exceeds 22%, an aesthetic appearance is spoiled. Thus, Cr content may be 18 to 22%, may be 20 to 22%, and may be 19.5 to 20.5%.

Mo is an element that increases the transfer rate of nitrogen to the ferrite phase, and the diffusion rate of nitrogen in the ferrite phase, in the nitrogen absorption treatment. When Mo is less than 1.3%, the transfer rate and diffusion rate of nitrogen decrease. Furthermore, when Mo is less than 1.3%, corrosion resistance as a material deteriorates. On the other hand, when Mo exceeds 2.8%, hardening occurs, and the workability as the material worsens. Furthermore, when Mo exceeds 2.8%, a configuration organization of the surfacing layer 212 becomes significantly heterogeneous, and the aesthetic appearance is spoiled. Thus, Mo content may be 1.3 to 2.8%, may be 1.8 to 2.8%, and may be 2.25 to 2.35%.

Nb is an element that increases the transfer rate of nitrogen to the ferrite phase, and the diffusion rate of nitrogen in the ferrite phase, in the nitrogen absorption treatment. When Nb is less than 0.05%, the transfer rate and diffusion rate of nitrogen decrease. On the other hand, when Nb exceeds 0.50%, hardening occurs, and the workability as the material worsens. Furthermore, a deposition section is generated, and the aesthetic appearance is spoiled. Thus, Nb content may be 0.05 to 0.50%, may be 0.05 to 0.35%, and may be 0.15 to 0.25%.

Cu is an element that controls absorption of nitrogen in the ferrite phase in the nitrogen absorption treatment. When Cu is less than 0.1%, a variation in nitrogen content in the ferrite phase increases. On the other hand, when Cu exceeds 0.8%, the transfer rate of nitrogen to the ferrite phase decreases. Thus, the Cu content may be 0.1 to 0.8%, may be 0.1 to 0.2%, and may be 0.1 to 0.15%.

Ni is an element that inhibits the transfer of nitrogen to the ferrite phase, and the diffusion of nitrogen in the ferrite phase, in the nitrogen absorption treatment. When Ni is equal to or greater than 0.5%, the transfer rate and the diffusion rate of nitrogen decrease. Furthermore, it is possible that corrosion resistance worsens, and that it becomes difficult to prevent occurrence of a metal allergy and the like. Thus, Ni content may be less than 0.5%, may be less than 0.2%, and may be less than 0.1%.

Mn is an element that inhibits the transfer of nitrogen to the ferrite phase, and the diffusion of nitrogen in the ferrite phase, in the nitrogen absorption treatment. When Mn is equal to or greater than 0.8%, the transfer rate and the diffusion rate of nitrogen decrease. Thus, Mn content may be less than 0.8%, may be less than 0.5%, and may be less than 0.1%.

Si is an element that inhibits the transfer of nitrogen to the ferrite phase, and the diffusion of nitrogen in the ferrite phase, in the nitrogen absorption treatment. When Si is equal to or greater than 0.5%, the transfer rate and the diffusion rate of nitrogen decrease. Thus, Si content may be less than 0.5%, and may be less than 0.3%.

P is an element that inhibits the transfer of nitrogen to the ferrite phase, and the diffusion of nitrogen in the ferrite phase, in the nitrogen absorption treatment. When P is equal to or greater than 0.10%, the transfer rate and the diffusion rate of nitrogen decrease. Thus, P content may be less than 0.10%, and may be less than 0.03%.

S is an element that inhibits the transfer of nitrogen to the ferrite phase, and the diffusion of nitrogen in the ferrite phase, in the nitrogen absorption treatment. When S is equal to or greater than 0.05%, the transfer rate and the diffusion rate of nitrogen decrease. Thus, S content may be less than 0.05%, and may be less than 0.01%.

N is an element that inhibits the transfer of nitrogen to the ferrite phase, and the diffusion of nitrogen in the ferrite phase, in the nitrogen absorption treatment. When N is equal to or greater than 0.05%, the transfer rate and the diffusion rate of nitrogen decrease. Thus, N content may be less than 0.05%, and may be less than 0.01%.

C is an element that inhibits the transfer of nitrogen to the ferrite phase, and the diffusion of nitrogen in the ferrite phase, in the nitrogen absorption treatment. When C is equal to or greater than 0.05%, the transfer rate and the diffusion rate of nitrogen decrease. Thus, C content may be less than 0.05%, and may be less than 0.02%.

Note that, the base 211 is not limited to the configuration described above, and it is sufficient that the base 211 is formed of the ferrite phase.

Surfacing Layer

The surfacing layer 212 is provided by performing the nitrogen absorption treatment on the base material forming the base 211, to austenitize the ferrite phase. In the present exemplary embodiment, nitrogen content in the surfacing layer 212 is set to 1.0 to 1.6% in percent by mass. In other words, nitrogen is contained at high concentrations in the surfacing layer 212. Accordingly, anticorrosive performance in the surfacing layer 212 can be improved.

In addition, in the present exemplary embodiment, the surfacing layer 212 includes a first surfacing layer 212A and a second surfacing layer 212B.

The first surfacing layer 212A is provided at a position corresponding to the first surface 21A. In other words, the first surfacing layer 212A is provided along a direction extending from the first surface 21A and orthogonal to the first surface 21A, or a normal line direction of the first surface 21A.

In the present exemplary embodiment, a thickness t1 of the first surfacing layer 212A is 100 μm to 350 μm. In addition, the thicknesses t1 is a thickness of a layer formed of the austenitized phase, and, for example, in a visual field when SEM observation is performed at a magnification of 500 to 1000, is a shortest distance from the first surface 21A to a ferrite phase of a first mixed layer 213A described below.

Alternatively, the thickness t1 is a shortest distance from the first surface 21A to a shallowest location of the austenitized phase. Additionally, when a distance from the first surface 21A to each of a plurality of points that is short in distance to the ferrite phase is measured, an average value thereof may be defined as the thickness t1.

The second surfacing layer 212B is provided at a position corresponding to the second surface 21B. In other words, the second surfacing layer 212B is provided along a direction extending from the second surface 21B and orthogonal to the second surface 21B, or a normal line direction of the second surface 21B.

In the present exemplary embodiment, a thickness t2 of the second surfacing layer 212B is, similar to the thickness t1 of the first surfacing layer 212A, 100 μm to 350 μm. In addition, the thicknesses t2 is a thickness of a layer formed of the austenitized phase, and, for example, in a visual field when SEM observation is performed at a magnification of 500 to 1000, is a shortest distance from the second surface 21B to a ferrite phase of a second mixed layer 213B described below.

Alternatively, the thickness t2 is a shortest distance from the second surface 21B to a shallowest location of the austenitized phase. Additionally, when a distance from the second surface 21B to each of a plurality of points that is short in distance to the ferrite phase is measured, an average value thereof may be defined as the thickness t2.

Here, in the present exemplary embodiment, the surfacing layer 212 is provided such that a thickness t3 of the surfacing layer 212 at the corner portion 21C is larger than the thickness t1 of the first surfacing layer 212A and the thickness t2 of the second surfacing layer 212B. Specifically, the thickness t3 is equal to or greater than 150 μm, and may be equal to or greater than 200 μm.

Accordingly, the thickness t3 of the surfacing layer 212 at the corner portion 21C can be increased, and impact resistance can be improved, thus for example, even when the watch 1 is dropped and the corner 21C is impacted, damage to the corner portion 21C can be suppressed.

In addition, in the present exemplary embodiment, the thickness t3 is equal to or less than 550 μm, and may be equal to or less than 500 μm. Accordingly, it is possible to prevent a nitrogen absorption treatment time for providing the surfacing layer 212 from becoming too long.

Note that, in the present exemplary embodiment, the thickness of the surfacing layer 212 at the corner portion 21C is set to t3, by adjusting a degree of entrance of nitrogen in the nitrogen absorption treatment, and a cut amount in cutting performed after the nitrogen absorption treatment.

Note that, the thicknesses t3 is a thickness of a layer formed of the austenitized phase, and, for example, in a visual field when SEM observation is performed at a magnification of 500 to 1000, is a shortest distance from the corner portion 21C to the ferrite phase of the first mixed layer 213A, or to the ferrite phase of the second mixed layer 213B. Alternatively, the thickness t3 is a shortest distance from the corner portion 21C to a shallowest location of the austenitized phase. Additionally, when a distance from the corner portion 21C to each of a plurality of points that is short in distance to the ferrite phase is measured, an average value thereof may be defined as the thickness t3.

Mixed Layer

In a step of forming the surfacing layer 212, the mixed layer 213 is generated by a variation in transfer rate of nitrogen entering the base 211 formed of the ferrite phase. In other words, at a location where the transfer rate of nitrogen is high, nitrogen enters into a deep location of the ferrite phase and the location is austenitized, and at a location where the transfer rate of nitrogen is low, the ferrite phase is austenitized only up to a shallow location, thus the mixed layer 213 is formed in which the ferrite phase and the austenitized phase are mixed with each other with respect to a depth direction. Note that, the mixed layer 213 is a layer including a shallowest site to a deepest site of the austenitized phase when viewed in a cross-section, and is a layer thinner than the surfacing layer 212.

Here, in the present exemplary embodiment, the mixed layer 213 includes the first mixed layer 213A and the second mixed layer 213B. The first mixed layer 213A is a layer formed between the base 211 and the first surfacing layer 212A. The second mixed layer 213B is a layer formed between the base 211 and the second surfacing layer 212B.

Effect of Exemplary Embodiment

According to the present exemplary embodiment, the following advantageous effects can be produced.

The case main body 21 of the present exemplary embodiment is formed of austenitized ferritic stainless steel including the base 211 formed of the ferrite phase, and the surfacing layer 212 formed of the austenitized phase. Further, the case main body 21 includes the first surface 21A exposed to the external space, and the second surface 21B that is adjacent to the first surface 21A with the corner portion 21C interposed therebetween, and is exposed to the external space. Furthermore, the angle θ of the internal angle formed by the first surface 21A and the second surface 21B at the corner portion 21C is greater than 0° and less than 180°. In other words, the first surface 21A and the second surface 21B are configured such that the corner portion 21C protrudes toward the external space. Then, the surfacing layer 212 at the corner portion 21C is thicker in thickness than the first surfacing layer 212A in the first surface 21A and the second surfacing layer 212B in the second surface 21B.

Accordingly, the thickness t3 of the surfacing layer at the corner portion 21C protruding toward the external space, that is, the corner portions 21C that is easily subjected to strong impact and for which frequency of strong impact is high, can be increased, and impact resistance can be improved. Accordingly, for example, even when the watch 1 is dropped and the corner portion 21C is impacted, damage to the corner portion 21C can be suppressed. Accordingly, the case main body 21 that is robust against impact by dropping or the like can be implemented.

In the present exemplary embodiment, the thickness t3 of the surfacing layer 212 at the corner portion 21C is equal to or greater than 150 μm, and equal to or less than 550 μm, and may be equal to or greater than 200 μm, and equal to or less than 500 μm.

Accordingly, impact resistance at the corner portion 21C can be sufficiently ensured, and it is possible to suppress that a nitrogen absorption treatment time becomes too long.

In the present exemplary embodiment, the base 211 contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

This makes it possible to increase the transfer rate of nitrogen to the ferrite phase, and the diffusion rate of nitrogen in the ferrite phase, in the nitrogen absorption treatment.

In the present exemplary embodiment, the nitrogen content of the surfacing layer 212 is 1.0 to 1.6% in percent by mass.

Accordingly, anticorrosive performance in the surfacing layer 212 can be improved.

Evaluation Test

Next, an evaluation test was performed on a relationship between impact resistance performance and layer thickness of an austenitized surfacing layer.

Summary and a result of the evaluation test will be described below.

Impact Resistance Performance Test Method

First, a plurality of test pieces were produced each formed of ferritic stainless steel containing Cr: 20%, Mo: 2.1%, Nb: 0.2%, Cu: 0.1%, Ni: 0.05%, Mn: 0.5%, Si: 0.3%, p: 0.03%, S: 0.01%, N: 0.01%, and C: 0.02%, with a balance being formed of Fe and unavoidable impurities.

Next, by performing nitrogen absorption treatment on each of the test pieces, the plurality of test pieces each formed with an austenitized surfacing layer on a surface thereof were obtained.

Then, for each test piece, iron balls having weight of 10 g, 20 g, 30 g, 40 g, 50 g, 60 g, 70 g, and 80 g, respectively were dropped from a height of 1 m, and amounts of deformation in a vertical direction of the surfacing layer were measured.

Impact Resistance Performance Test Result

As shown in Table 1, for the iron ball having larger weight, the amount of deformation in the vertical direction of the surfacing layer was larger, and assumed load was increased. Note that, in the present test, the assumed load was determined by the following equation. Also, as a result of a separate test, Vickers hardness of the test piece of the present test was 380 Hv.

$$P=13.22\times H\times(D/1000)2$$ Assumed Load Calculation Equation

P: assumed load [kg]
H: Vickers hardness of the test piece [Hv]
D: amount of deformation [μm]

TABLE 1

| IRON BALL WEIGHT [g] | AMOUNT OF DEFORMATION [μm] | ASSUMED LOAD [kg] | REQUIRED LAYER THICKNESS [μm] |
|---|---|---|---|
| 10 | 10 | 0.5 | 70 |
| 20 | 20 | 2.0 | 140 |
| 30 | 30 | 4.5 | 210 |
| 40 | 40 | 8.0 | 280 |
| 50 | 50 | 12.6 | 350 |
| 60 | 60 | 18.1 | 420 |
| 70 | 70 | 24.6 | 490 |
| 80 | 80 | 32.2 | 560 |

Here, when the test piece or the like is impacted, and the test piece deforms, a range of seven times the amount of deformation is said to be affected. Thus, in the present test, the layer thickness of the surfacing layer required for the assumed load was evaluated as seven times the amount of deformation.

As shown in Table 1, in general, the assumed load as impact on the watch, is approximately 2 kg, thus it was suggested that the layer thickness of the surfacing layer required for this assumed load is 140 μm.

In the exemplary embodiment described above, the thickness t3 of the surfacing layer 212 at the corner portion 21C is equal to or greater than 150 μm, thus it was suggested that the surfacing layer has sufficient impact resistance performance for the assumed load as the impact to the watch.

Modification Example

Note that the present disclosure is not limited to each of the exemplary embodiments described above, and variations, modifications, and the like within the scope in which the object of the present disclosure can be achieved are included in the present disclosure.

In the exemplary embodiment described above, the housing of the present disclosure is configured as the case main body 21 for the watch, but is not limited thereto. For example, the housing of the present disclosure may be configured as at least one of a case back and a bezel. Additionally, the watch may have a plurality of the components as described above.

In the exemplary embodiment described above, the corner portion 21C is configured such that the angle θ of the internal angle formed by the first surface 21A and the second surface 21B is greater than 0° and less than 180°, but is not limited thereto. For example, the corner portion may be configured to have a curved shape (R shape), and may be configured such that an angle of an internal angle formed by a virtual extension line along the first surface and a virtual extension line along the second surface is greater than 0° and less than 180° in cross-sectional view. In this case, a thickest portion of a surfacing layer at the corner portion configured to have the curved shape may be configured to be thicker in thickness than a surfacing layer in the first surface and a surfacing layer in the second surface.

In the exemplary embodiment described above, the first surface 21A and the second surface 21B are disposed closer to the case back 22 than the crown 26, but are not limited thereto. For example, the first surface and the second surface may be disposed closer to the glass plate than the crown.

In the exemplary embodiment described above, the corner portion 21C is constituted by two surfaces, the first surface 21A and the second surface 21B, but is not limited thereto. For example, the corner portion may be constituted by three or more surfaces. That is, the corner portion may be a location that couples three or more surfaces with each other.

In the exemplary embodiment described above, the case main body 21 is configured as the watch component, but is not limited thereto. For example, the case main body 21 may be configured as a housing of an electronic device other than a watch, or the like. That is, a housing may be configured as a housing for an electronic device, and the device of the present disclosure may be configured as an electronic device. By including a housing configured in this way, an electronic device can have high impact resistance performance.

Summary of Present Disclosure

A housing of the present disclosure is a housing formed of austenitized ferritic stainless steel including a base formed of a ferrite phase, and a surfacing layer formed of an austenitized phase in which the ferrite phase is austenitized, that includes a first surface exposed to an external space of the housing, and a second surface adjacent to the first surface with a corner portion interposed therebetween, and exposed to the external space, wherein an angle of an internal angle formed by the first surface and the second surface at the corner portion is greater than 0°, and less than 180°, and a surfacing layer at the corner portion is thicker in thickness than a surfacing layer in the first surface and a surfacing layer in the second surface.

Accordingly, a thickness of the surfacing layer at the corner portion protruding toward the external space, that is, the corner portions that is easily subjected to strong impact and for which frequency of strong impact is high, can be increased, and impact resistance can be improved. Accordingly, for example, even when the housing is dropped and the corner portion is impacted, damage to the corner portion can be suppressed. Thus, a housing that is robust against impact by dropping or the like can be implemented.

In the housing of the present disclosure, the thickness of the surfacing layer at the corner portion may be equal to or greater than 150 μm, and equal to or less than 550 μm.

Accordingly, impact resistance at the corner portion can be ensured, and it is possible to suppress that a nitrogen absorption treatment time becomes too long.

In the housing of the present disclosure, the thickness of the surfacing layer at the corner portion may be equal to or greater than 200 μm, and equal to or less than 500 μm.

Accordingly, the impact resistance at the corner portion can be more sufficiently ensured, and it is possible to suppress that the nitrogen absorption treatment time becomes too long.

In the housing of the present disclosure, the base may contain, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

This makes it possible to increase the transfer rate of nitrogen to the ferrite phase, and a diffusion rate of nitrogen in the ferrite phase, in the nitrogen absorption treatment.

In the housing of the present disclosure, nitrogen content of the surfacing layer may be 1.0 to 1.6% in percent by mass.

Accordingly, anticorrosive performance in the surfacing layer can be improved.

A device including the housing of the present disclosure.

What is claimed is:

1. A housing formed of austenitized ferritic stainless steel comprising:

a base formed of a ferrite phase, a surfacing layer formed on the base and having an austenitized phase in which the ferrite phase is austenitized, and a mixed layer between the base and the surfacing layer where the ferrite phase and the austenitized phase are mixed;

wherein:

the base contains, in percent by mass, Cr: 18 to 22%, Mo: 1.3 to 2.8%, Nb: 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities;

the surfacing layer contains 1.6% percent by mass of nitrogen;

the housing includes:

a first surface exposed to an external space of the housing; and a second surface adjacent to the first surface with a corner portion interposed therebetween, and exposed to the external space; wherein an angle of an internal angle formed by the first surface and the second surface at the corner portion is greater than 0° and less than 180°, and a thickness of the surfacing layer at the corner portion is greater than both of a thickness of the surfacing layer at the first surface and a thickness of the surfacing layer at the second surface.

2. The housing according to claim 1, wherein a thickness of the surfacing layer at the corner portion is from 150 μm to 550 μm.

3. The housing according to claim 2, wherein the thickness of the surfacing layer at the corner portion is from 200 μm to 500 μm.

4. A device comprising the housing according to claim 1.

5. A device comprising the housing according to claim 2.

6. A device comprising the housing according to claim 3.

* * * * *